US009024100B2

(12) United States Patent
Wang et al.

(10) Patent No.: US 9,024,100 B2
(45) Date of Patent: May 5, 2015

(54) PROCESS FOR PRODUCING OLEFINS

(75) Inventors: Guoqing Wang, Beijing (CN); Zhaobin Zhang, Beijing (CN); Shuo Chen, Beijing (CN); Lijun Zhang, Beijing (CN)

(73) Assignees: China Petroleum & Chemical Corporation, Beijing (CN); Beijing Research Institute of Chemical Industry, China Petroleum & Chemical Corporation, Beijing (CN)

( * ) Notice: Subject to any disclaimer, the term of this patent is extended or adjusted under 35 U.S.C. 154(b) by 724 days.

(21) Appl. No.: 12/669,269

(22) PCT Filed: Jul. 18, 2008

(86) PCT No.: PCT/CN2008/001340

§ 371 (c)(1),
(2), (4) Date: Jun. 28, 2010

(87) PCT Pub. No.: WO2009/009965

PCT Pub. Date: Jan. 22, 2009

(65) Prior Publication Data

US 2010/0274063 A1 Oct. 28, 2010

(30) Foreign Application Priority Data

Jul. 19, 2007 (CN) ..... 2007 1 0119257

(51) Int. Cl.
*C07C 5/327* (2006.01)
*C07C 4/02* (2006.01)
(Continued)

(52) U.S. Cl.
CPC ..... *C10G 35/09* (2013.01); *C10G 11/05* (2013.01); *C10G 11/18* (2013.01)

(58) Field of Classification Search
USPC ..... 208/49, 62; 585/310, 324, 654, 655, 585/648
See application file for complete search history.

(56) References Cited

U.S. PATENT DOCUMENTS 2,254,553 A * 9/1941 Thomas ..... 208/49
2,254,555 A * 9/1941 Thomas ..... 208/66
(Continued)

FOREIGN PATENT DOCUMENTS

CA 2380059 11/2001
CN 1317467 A 10/2001
(Continued)

OTHER PUBLICATIONS

Barker, et al., "Petroleum" in Kirk-Othmer Encyclopedia of Chemical Technology, 2005, John Wiley & Sons, available on-line May 13, 2005.*
(Continued)

*Primary Examiner* — Thuan D Dang
(74) *Attorney, Agent, or Firm* — Finnegan, Henderson, Farabow, Garrett & Dunner, LLP

(57) ABSTRACT

The present invention discloses a process for producing olefins from petroleum saturated hydrocarbons. The process of the present invention comprises: contacting a preheated petroleum saturated hydrocarbons feedstock with a dehydrogenation catalyst in a dehydrogenation reaction zone of a reaction system to obtain a petroleum hydrocarbon stream containing unsaturated hydrocarbon compounds, in which the dehydrogenation reaction has a conversion rate of at least 20%; and contacting the obtained petroleum hydrocarbon stream containing the unsaturated hydrocarbon compounds with olefins cracking catalyst in an olefin cracking zone of the reaction system to obtain a product stream containing olefins with a reduced number of carbon atoms.

15 Claims, 1 Drawing Sheet

(51) Int. Cl.

| | |
|---|---|
| ***C10G 51/02*** | (2006.01) |
| ***C10G 35/09*** | (2006.01) |
| ***C10G 11/05*** | (2006.01) |
| ***C10G 11/18*** | (2006.01) |

(56) References Cited

U.S. PATENT DOCUMENTS

| | | | | |
|---|---|---|---|---|
| 2,322,366 | A * | 6/1943 | Kassel | 208/49 |
| 2,349,160 | A * | 5/1944 | Frey et al. | 208/49 |
| 4,762,960 | A * | 8/1988 | Imai | 585/660 |
| 4,840,928 | A * | 6/1989 | Harandi et al. | 502/41 |
| 4,859,308 | A * | 8/1989 | Harandi et al. | 208/49 |
| 5,489,724 | A * | 2/1996 | Harandi | 585/659 |
| 6,586,649 | B1 | 7/2003 | Botha et al. | |
| 6,875,338 | B2 | 4/2005 | Lenglet et al. | |
| 7,893,311 | B2 | 2/2011 | Takamatsu et al. | |
| 2003/0139636 | A1 * | 7/2003 | Chen et al. | 585/653 |
| 2005/0096492 | A1 * | 5/2005 | Dath et al. | 585/653 |

FOREIGN PATENT DOCUMENTS

| | | | |
|---|---|---|---|
| CN | 1380898 | A | 11/2002 |
| CN | 1480255 | A | 3/2004 |
| CN | 1565732 | A | 1/2005 |
| CN | 1915920 | A | 2/2007 |
| EP | 1318187 | | 7/2007 |
| JP | H01176452 | A | 7/1989 |
| JP | H06509382 | A | 10/1994 |
| JP | 2002-206091 | A | 7/2002 |
| WO | WO 93/03116 | | 2/1993 |
| WO | WO 99/57087 | A1 | 11/1999 |
| WO | WO2004/072002 | A1 | 8/2004 |
| WO | WO2007/032448 | A1 | 3/2007 |

OTHER PUBLICATIONS

Speight, Lange's Handbook of Chemistry, 16th edition, McGraw-Hill, 2005—month unknown.*

Wang et al., "Conversion of $C_5$ olefins to propylene and ethylene," *Journal of Petroleum Chemical Industry*, vol. 34(6), 2005: pp. 513-517.

Jin et al., "Catalytic cracking of mixed $C_4$ olefins over PZSM-5 Zeolite," *Journal of Industrial Catalysis*, vol. 12(10), Oct. 2004: pp. 5-7.

International Search Report for PCT/CN2008/001340 dated Oct. 30, 2008.

English Language Abstract for CN 1480255A dated Oct. 18, 2012.

English Language Abstract for CN 1565732A dated Oct. 18, 2012.

English Language Abstract for CN 1915920A dated Oct. 18, 2012.

Journal of Liaoning Chemical Industry, 1992, pp. 16-19.

English Language Abstract for JPH01176452 A dated Apr. 19, 2013.

English Language Abstract for WO2004/072002 A1 dated Apr. 19, 2013.

Supplementary European Search Report dated Jan. 16, 2013, for European Patent Application No. EP 08783535.

Communication pursuant to Article 94(3) EPC dated Jul. 24, 2014, for European Patent Application No. EP 08 783 535.1, (5 pages).

* cited by examiner

PROCESS FOR PRODUCING OLEFINS

FIELD OF THE INVENTION

The present invention relates to a process for producing olefins from petroleum saturated hydrocarbons. In particular, the present invention relates to a process for producing lower olefins, especially ethylene and propylene, by using a mixture of saturated $C_4$-$C_{35}$ hydrocarbons as raw material.

BACKGROUND OF THE INVENTION

Steam cracking method is most popularly used for producing lower olefins such as ethylene, propylene, butadiene and so forth from petroleum saturated hydrocarbons. About 99% of ethylene and more than 50% of propylene in the world are produced by this method. The operating conditions of steam cracking method are very stringent, for example, the maximum tube metal temperature (TMT) of the cracking furnace can reach 1125° C., and the bulk residence time of feedstocks in the radiant section tube can be 0.2 s or shorter. In the meantime, since the steam cracking products contain hydrogen, alkanes, alkenes, dienes and arenes having up to 40 or more carbons, in particular about 15 mol % of hydrogen and methane, the steam cracking products may have to be subjected to compression, complicated heat exchange, rectification and even low temperature cryogenic separation at ≤−160° C.

In view of this situation, many attempts have been made to produce lower olefins by other methods, including catalytic cracking, oxidative coupling of methane, and producing olefins from natural gas through methanol, in which the catalytic cracking methods for producing lower olefins from petroleum saturated hydrocarbons can be performed at a relatively low cracking temperature to improve the selectivity of the desired product (lower olefins) and thus catch a lot of attentions.

The methods of catalytic cracking petroleum saturated hydrocarbons may be performed in many ways including fixed bed catalytic cracking methods, fluidized bed catalytic cracking methods and so forth. Currently, the fluidized bed catalytic cracking methods (FCC technology) are primarily applied to heavy oils to generate light oils as main product and lower hydrocarbons (mainly comprising propylene) as byproducts (see, e.g., CNO2129551; CN1380898A), while the fixed bed catalytic cracking methods are mainly applied to light feedstocks such as naphtha, in which the stringency of the operating conditions for cracking petroleum saturated hydrocarbons are significantly reduced while the yields of the desired products (ethylene and propylene) are elevated. The catalytic cracking technologies that are suitable for naphtha and developed in recent years primarily pertain to fixed bed catalytic cracking technologies (see, e.g., CNO2129551; CN1380898A; CN200510028797; CNO3141148). It is believed that such fixed bed catalytic cracking reaction may increase the yield of the desired products to some extent, and may also decrease the cracking reaction temperature to some extent (relative to heat cracking reaction). However, the solid catalyst loaded in the reaction tube may cause unevenness of heat distribution in the reactor, and the coking of petroleum saturated hydrocarbons at high temperature may result in the decrease of activity or deactivation of catalyst, so that besides a component for inhibiting coking may have to be added, the amount of the dilution steam must be increased, which lead to the decrease of efficiency. In addition, the scale-up of the fixed catalytic cracking technologies may also have some problems. Investment costs for building a catalytic cracking furnace is remarkably higher than that of a steam cracking furnace with an equivalent capacity. Due to this point, the fixed bed catalytic cracking technology is still at a level far from industrialization.

Moreover, in conventional steam cracking technologies and catalytic cracking technologies, energy consumption during separation is high since the amount of small molecules such as hydrogen and methane in the cracking products is relatively great (about 15 mol %).

EP 1318187 A1 discloses an apparatus for cracking saturated hydrocarbons, in which the saturated hydrocarbons are cracked into $C_4$-$C_8$ unsaturated hydrocarbons, whereby propylene, butene and so forth were obtained, and in which a heat exchanger (7) can optionally comprise cracking, disproportionation and/or dehydrogenation catalysts or comprise no catalyst. That document does not give any other teachings about dehydrogenation reaction.

U.S. Pat. No. 6,586,649 B1 discloses that a product comprising 8% of ethylene, 35% of propylene and 20% of $C_4$ fraction is obtained from a Fisher-Tropsch dehydrogenation raw material by using a $C_4$ disproportionation technology. That document also mentions a feedstock containing butanes obtained from dehydrogenation of paraffins, but does not give any further teaching. In addition, the $C_4$ disproportionation reaction disclosed in that document is different from the catalytic cracking reaction, and thus is not suitable for the treatment of petroleum saturated hydrocarbons, which restricts its application.

CN1317467A discloses the use of a dehydrogenation product of $C_4$-$C_6$ lower alkanee to improve the catalytic cracking of lower alkanes. In that process, the raw materials being treated by the catalytic cracking step are lower alkanes, in particular feed oils for catalytic cracking, which have never been dehydrogenated. The dehydrogenated lower alkanes merely act as promoters, and thus the conversion rate of their dehydrogenation is only up to 16.8 wt %. Additionally, a macroporous zeolite catalyst suitable for cracking alkanes is used in the cracking step. The Examples of that document merely relate to pure n-pentane, and from which it can be found that comparing with the situation where no dehydrogenation is performed, different conversion rates of the dehydrogenation do not significantly influence the improvement of selectivity of ethylene and propylene. For example, according to the Examples of that document, higher dehydrogenation conversion rate (e.g., 14.8 wt % of Example 6) and lower dehydrogenation conversion rate (e.g., 3.2 wt % of Example 5) result in equivalent improvement of selectivity of ethylene and propylene (e.g., the percentage is 9.89 in Example 6, and 9.26 in Example 5).

Thus, a process that uses petroleum saturated hydrocarbons as raw material is still in need, upon which energy consumption and raw material consumption are remarkably reduced, and the yield of lower olefins is significantly elevated.

SUMMARY OF INVENTION

The object of the present invention is to provide a process for producing olefins, especially lower olefins such as ethylene and propylene by using petroleum saturated hydrocarbons as raw material, which process is different from steam cracking technology.

The process for producing olefins from petroleum saturated hydrocarbons according to the present invention comprises the following steps:

1) contacting a preheated petroleum saturated hydrocarbons feedstock with a dehydrogenation catalyst in a dehydrogenation reaction zone of a reaction system to obtain a petroleum hydrocarbon stream containing unsaturated hydrocarbon compounds, in which the dehydrogenation reaction has a conversion rate of at least 20%;

2) contacting the petroleum hydrocarbon stream containing the unsaturated hydrocarbon compounds obtained in step 1) with the olefins cracking catalyst in an olefin cracking zone of the reaction system to obtain a product stream containing olefins with a reduced number of carbon atoms.

The petroleum saturated hydrocarbons feedstock suitable for the process of the present invention may comprise a mixture of hydrocarbons selected from $C_4$-$C_{35}$ saturated hydrocarbons, preferably a mixture of hydrocarbons selected from $C_6$-$C_{20}$ saturated hydrocarbons.

Preferably, in step 1), the petroleum saturated hydrocarbons feedstock together with a diluent is fed into the dehydrogenation reaction zone to contact with the dehydrogenation catalyst in the dehydrogenation reaction zone to obtain the unsaturated hydrocarbon compounds; in step 2), the petroleum hydrocarbon stream containing the unsaturated hydrocarbon compounds together with a diluent is fed into the olefin cracking reaction zone to contact with the olefin cracking catalyst in the olefin cracking reaction zone to obtain olefins with a reduced number of carbon atoms.

The diluents can be introduced into a mixer for mixing, then introduced into the reaction zones; or can be directly mixed and introduced into the reaction zones. Preferably, the diluents are selected from water steam and hydrogen gas. According to the non-limited embodiments of the present invention, the diluent in the dehydrogenation reaction zone has a diluting ratio (ratio of water to oil) of 0 to 20, preferably 0 to 10; or, in addition, in the olefin cracking reaction zone, has a diluting ratio of 0 to 1.5, preferably 0 to 5.

In step 1), the dehydrogenation reaction is usually performed at a temperature of 300 to 700° C., preferably 400 to 600° C.; and a pressure of 0 to 1000 kPa(G), preferably 0 to 300 kPa(G). The petroleum saturated hydrocarbons feedstock may have a space velocity of 0.5 to 10 $h^{-1}$, preferably 1 to 5 $h^{-1}$.

In step 1), the conversion ratio per pass of the dehydrogenation should be at least 20%, preferably at least 25%, more preferably at least 30%, usually less than or equal to 65%, preferably less than or equal to 55%, more preferably less than or equal to 50%, including the combinations of the above ranges.

In step 1), the obtained petroleum hydrocarbon stream containing the unsaturated hydrocarbon compounds usually comprises un-reacted saturated hydrocarbons, hydrogen and a small amount of hydrocarbons having 4 or less carbon atoms. In the dehydrogenation reaction zone of the present invention, the petroleum saturated hydrocarbons mainly undergo dehydrogenation reaction, but rarely carbon-carbon cleavage reaction. Thus, the obtained unsaturated hydrocarbon compounds and the petroleum saturated hydrocarbons of the feedstock have substantially the same number of carbon atoms.

Before introducing the petroleum hydrocarbon stream containing the unsaturated hydrocarbon compounds into the olefin cracking reaction zone, said stream is preferably subjected to a gas-liquid separation in advance to separate out the $C_4$ or less components and hydrogen contained in the post-dehydrogenation stream. In the meantime, the liquid petroleum hydrocarbons stream containing the unsaturated hydrocarbon compounds is introduced into the olefin cracking reaction zone to perform the olefin cracking reaction of step 2).

Preferably, the olefin cracking reaction of step 2) is performed at a temperature of ≥400° C., preferably ≥500° C., preferably ≤600° C., more preferably ≤550° C.; a pressure of 0.05 to 0.5 MPa(G), preferably 0.05 to 0.1 MPa(G); and a space velocity of 1.0 to 30 $h^{-1}$, preferably 1.5 to 20 $h^{-1}$, including the combinations of the above ranges. The reaction temperature is preferably 500° C. to 550° C., the reaction pressure is preferably 1 bar to 3 bar, and the space velocity is preferably 3 $h^{-1}$ to 8 $h^{-1}$.

The olefins with a reduced number of carbon atoms can be one or more of $C_2$-$C_9$ olefins, preferably one or more of $C_2$-$C_4$ olefins.

When the desired product is lower olefins, the olefin cracking reaction is to cleave larger olefins (having >4 carbon atoms) to form smaller olefins (having ≤4 carbon atoms).

The process according to the present invention further comprises a step 3): separating the stream containing $C_2$-$C_9$ olefins obtained in step 2). When desired, products rich in $C_2$ olefin, $C_3$ olefins and $C_4$ olefins, as well as products rich in $C_5$, $C_6$, $C_7$, $C_8$ and/or $C_9$ olefins can be separated out.

In step 3), the separation step may comprise compression, rectification and extraction. In some non-limited embodiments of the present invention, the desired products can be obtained by performing extraction, rectification or so on in a separation apparatus depends on the composition and proportion of the olefin products. The selections of such separation are known by those skilled in the art, and thus are not further described in details.

According to one embodiment of the present invention, in step 3), the stream containing $C_2$-$C_4$ olefins is separated to obtain a stream rich in $C_2$-$C_4$ olefins and a stream containing $C_4$ or heavier components, whereby obtaining ethylene, propylene, butene and butadiene, etc., respectively.

DETAILED DESCRIPTION

Figure 1:
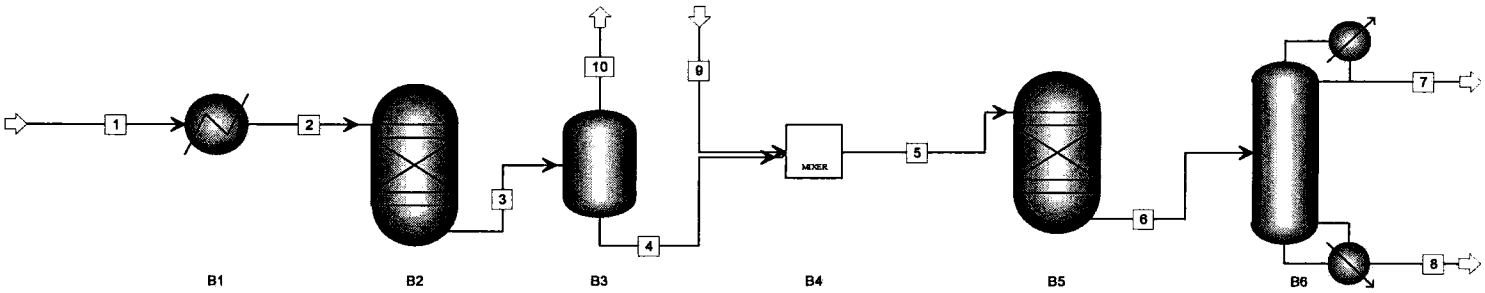
FIG. 1 is a schematic flow diagram of an embodiment according to the present invention.

For the purpose of the present application, all numbers expressing amounts, reaction conditions and so forth used in the description and claims, unless in Examples or otherwise specified, should be understood as modifiable by the term "about". Thus, unless otherwise specified, the numerical parameters in the description and claims are approximations, which may vary according to the desired and expected performances of the present invention. Each numerical parameter should be construed in light of at least the number of reported significant digits and by applying normal rounding techniques.

Notwithstanding the aforementioned broad numerical ranges and parameters are approximations, the specific values in the Examples are reported as precisely as possible. However, any of the values inherently contain errors caused by standard deviations inevitably existing in the testing measurements.

In the present invention, the following terms have the following meanings, unless otherwise specifically described.

Petroleum Saturated Hydrocarbons Feedstock

The petroleum saturated hydrocarbons feedstock suitable for the process of the present invention may comprise a mixture of hydrocarbons selected from $C_4$-$C_{35}$ hydrocarbons, preferably a mixture of hydrocarbons selected from $C_6$-$C_{20}$ hydrocarbons. The petroleum saturated hydrocarbons feedstock may be derived from any conventional processes. For example, the feedstock can be one of topped oil, pentane oil, naphtha, a mixture of normal alkanes, or a mixture thereof. The present invention is particularly suitable for producing lower hydrocarbons by using naphtha as raw material.

Lower Olefins

In the present application, "lower olefins" mainly refers to olefins having less than 5 carbon atoms, including but not limited to ethylene, propylene, butene and butadiene.

Dehydrogenation Catalysts

The term "dehydrogenation catalysts in a catalytically effective amount" refers to catalysts capable of catalyzing the dehydrogenation reaction of the saturated hydrocarbon compounds, and the amount thereof is sufficient for catalyzing the reaction. The dehydrogenation catalyst can be a conventional dehydrogenation catalyst known in the art. According to the non-limited embodiments of the present invention, the dehydrogenation catalyst comprises an active component loaded on a carrier and an optional additive component.

The active component is preferably selected from the group consisting of Pt, Pb, chromium oxide, Ni or a combination thereof.

The additive component is preferably selected from the group consisting of Sn, alkali metal, alkaline earth metal or a combination thereof.

The carrier is preferably selected from the group consisting of alumina, molecular sieves, kaolin, diatomite, silica or a combination thereof.

The molecular sieves suitable for the dehydrogenation step of the present invention may comprise any natural or synthetic molecular sieves. The examples of these molecular sieves comprise small pore molecular sieves, mesopore molecular sieves and large pore molecular sieves. The pore diameter of the small pore molecular sieves is about 3 to 5.0 angstroms, including, for example, CHA-, ERI-, LEV- and LTA- structural-type zeolites. The examples of the small pore molecular sieves include ZK-4, ZK-5, ZK-14, ZK-20, ZK-21, ZK-22, ZSM-2, zeolite A, zeolite T, hydroxyl natrolite, erionite, chabazite, gmelinite, clinoptilolite, SAPO-34, SAPO-35, SAPO-42 and ALPO-17. Typically, the mesopore molecular sieves have a pore diameter of about 5 to 7 angstroms, including, for example, AEL-, AFO-, EUO-, FER-, HEU-, MEL-, MFI-, MFS-, MTT-, MTW- and TON-structural-type zeolites. The examples of the mesopore molecular sieves include MCM-22, MCM-36, MCM-49, MCM-56, MCM-68, ZSM-5, ZSM-11, ZSM-12, ZSM-22, ZSM-23, ZSM-34, ZSM-35, ZSM-38, ZSM-48, ZSM-50 and ZSM-57. Typically, the large pore molecular sieves have a pore diameter of above about 7 angstrom, and comprises *BEA-, BOG-, EMT-, FAU-, LTL-, MAZ-, MEI-, MOR-, OFF- and VFI- structural-type zeolites. The examples of the large pore molecular sieves include mazzite, offretite, zeolite L, zeolite X, zeolite Y, β-zeolite, ω-zeolite, ETAS-10, ETS-10, ETGS-10, MCM-9, SAPO-37, ZSM-3, ZSM-4 and ZSM-20.

Molecular sieves such as zeolites may comprise silicates, metal silicates such as aluminosilicates and gallosilicates, as well as ALPO-based molecular sieves such as metal aluminophosphates (MeAPO), aluminophosphates (ALPO), silicoaluminophosphates (SAPO) and metal aluminophosphosilicates (MeAPSO).

According to a non-limited embodiment of the present invention, for example, the dehydrogenation catalysts of DEH-series from UOP Company can be used, whose main components include alumina as carrier, Pt as active component, Sn/Li as active additive. The reaction temperature is 450 to 500° C., and the reaction pressure is 0.1 to 0.3 MPa. The use of the above catalyst is described in *Journal of Liaoning Chemical Industry,* 5, 1992: pages 16-19. That document is incorporated herein by reference.

Dehydrogenation Reaction Zone

The term "dehydrogenation reaction zone" used herein refers to a zone mainly used for performing dehydrogenation reaction in the reaction system. The zone can be one or several sections in the same reactor, or a single reactor (i.e., dehydrogenation reactor).

The specific form of the dehydrogenation reaction zone suitable for the present invention can be a fixed bed, a fluidized bed or a moving bed, preferably a fixed bed or a fluidized bed.

The products in dehydrogenation reaction zone typically have the following distribution:

TABLE A distribution of the products in dehydrogenation reaction zone
Product distribution (weight %)

| components | proper ranges | preferable ranges |
|---|---|---|
| alkanes | 10 to 70 | 20 to 60 |
| olefins | 20 to 60 | 30 to 50 |
| dienes | 2 to 10 | 4 to 6 |
| arenes | 2 to 10 | 4 to 6 |

Olefins Cracking Catalysts

The term "olefins cracking catalysts in a catalytically effective amount" used in the specification refers to catalysts capable of catalyzing the reaction of cracking unsaturated hydrocarbon compounds, and the amount thereof is sufficient for catalyzing the reaction.

The olefins cracking catalysts are modified or unmodified molecular sieve catalysts.

Suitable molecular sieves can be molecular sieves having a pore diameter of 4 to 7 angstroms, such as one or more of SAPO series, ZSM series, MCM series and so forth having the aforementioned pore diameters, or a combination thereof.

Useful modifying elements can be one of alkaline earth metals, rare earth metals and solid super acids such as Zr or Ni, or a combination thereof.

According to a non-limited embodiment of the present invention, a catalyst having silica as carrier, ZSM-5 and ZRP as active component, elements such as Mo, Ni, Ca, Mg, Ce, P, Re and Pt as additive is used, the reaction temperature can be 400 to 550° C., and the reaction pressure can be 0.1 to 1.0 MPa. The above catalysts are described in *Journal of Petroleum Chemical Industry*, vol. 34(6), 2005: pages 513-517, and *Journal of Industrial Catalysis*, vol. 12(10), October 2004: pages 5-7. Those documents are incorporated herein by reference.

Olefin Cracking Reaction Zone

The term "olefin cracking reaction zone" used herein refers to a zone mainly used for cracking olefins in the reaction system. The zone can be one or several sections in the same reactor, or a single reactor (i.e., olefin cracking reactor). According to a non-limited embodiment of the present invention, the dehydrogenation reaction zone and the olefin cracking reaction zone are in the same reactor. According to another non-limited embodiment, the dehydrogenation reaction zone and the olefin cracking reaction zone are in different reactors.

The specific form of the olefin cracking reaction zone suitable for the present invention can be a fixed bed, a fluidized bed or a moving bed, preferably a fixed bed or a fluidized bed.

The products in olefin cracking zone according to the process of the present invention typically have the following distribution:

TABLE B distribution of the products in olefin cracking zone
Product distribution (wt %)

| components | ranges |
|---|---|
| $H_2$ | ≤5.0 |
| $CH_4$ | ≤1.0 |
| $C_2H_4$ | 1.0 to 15.0 |
| $C_2H_6$ | ≤2.0 |
| $C_3H_6$ | 15 to 30 |
| $C_3H_8$ | 1.0 to 5.0 |
| $C_4$= | 5.0 to 30.0 |
| $C_4$ alkanes | 2.0 to 15.0 |
| $C_5$= | 3.0 to 10.0 |
| $C_5$ alkanes | 0.5 to 2.5 |
| $C_6$= | 0.5 to 5.5 |
| $C_6$ alkanes | 0.1 to 0.8 |
| $C_7$= | 2.0 to 5.0 |
| $C_7$ alkanes | 0.1 to 1.0 |
| $C_8$= | 0.1 to 3.0 |
| $C_8$ alkanes | 0.1 to 1.0 |
| $C_9$= | 0.1 to 3.0 |
| $C_9$ alkanes | 0.5 to 3.0 |
| other components | ≤1.0 |

The process according to the present invention is of applicability in producing a broad spectrum of olefins, and can be adjusted flexibly according to the desired products.

According to a non-limited embodiment of the present invention, the gas-liquid separation is performed after the dehydrogenation step. The separated hydrogen gas and some gaseous streams with a lower carbon number can be used as a source of heat.

Additionally, the liquid stream from which $C_4$ or lower components and hydrogen are separated out can be further separated to obtain a stream rich in saturated hydrocarbons and a stream rich in unsaturated hydrocarbons, in which the stream rich in unsaturated hydrocarbons obtained by separation can be introduced into the olefin cracking reaction zone for olefin transformation; or, in addition, the stream rich in saturated hydrocarbons obtained by separation can be preferably fed back as raw material and introduced together with the petroleum saturated hydrocarbons feedstock into the dehydrogenation reaction zone.

Alternatively, according to another embodiment of the present invention, the unreacted saturated hydrocarbon compounds in the petroleum saturated hydrocarbons feedstock after dehydrogenation may not be subjected to the separation, but used as a diluent of the olefin cracking reaction to reduce the coking in the reaction zone.

According to a non-limited embodiment of the present invention, in the downstream of the olefin cracking reaction zone, a product separation zone is further comprised to separate the obtained stream comprising $C_2$-$C_9$ olefins.

According to a preferred embodiment, when the desired product is lower olefins, the separated higher olefins can be fed back to the olefin cracking reaction zone, and subjected to the catalytic cracking together with the dehydrogenated petroleum saturated hydrocarbon stream. The separation can be performed in any conventional manner, such as but not limited to simple gas-liquid separation.

Some of the embodiments of the present invention are described above. As those skilled in the art can readily understand, these embodiments can be combined and modified, unless otherwise specified.

Benefit Effects Of The Present Process

1. According to the process of the present invention, the temperature for dehydrogenating petroleum saturated hydrocarbons and for olefins transformation are significantly lower than those of the conventional steam cracking and catalytic cracking technologies. Thus, a great amount of energy can be saved; the use of high temperature equipments can be reduced or avoided, thereby reducing the investment and maintenance costs.

2. According to the process of the present invention, after the dehydrogenation step, hydrogen gas and methane can be separated out from the other streams by using a simple gas-liquid separation. In addition, in the sequent olefins cracking step, few or no hydrogen and methane are generated. Thus, the separation of lower carbon number streams such as hydrogen and methane from the desired lower olefin product could be reduced, and the absence of separation between alkanes and olefins having same number of carbon atoms can significantly reduce the energy consumption involved in separation.

3. The process of the present invention can be readily and flexibly adjusted according to the desired products.

EXAMPLES

The below examples illustrate the present invention. It should be understood that the scope of the present invention is not limited to these Examples. Those skilled in the art can envisage any variations and changes without departing from the spirit of the present invention. The protection scope of the present invention is defined by the claims. Unless specified otherwise, the percentages and parts in the description and the Examples are based on weight, the temperature is based on degree Celsius, and the pressure is based on absolute pressure.

In the below Examples and comparative Examples, a light naphtha of the following composition is used.

| Carbon number | Alkanes | Olefins | Cycloalkanes | Arenes | Total |
|---|---|---|---|---|---|
| 4 | 2 | 0.02 | 0 | 0 | 2.02 |
| 5 | 32.7 | 0.3 | 0.58 | 0 | 33.58 |
| 6 | 24.12 | 0.28 | 3.57 | 2.29 | 30.26 |
| 7 | 12.96 | 0.12 | 4.12 | 2.37 | 19.57 |
| 8 | 6.59 | 0 | 1.72 | 2.09 | 10.4 |
| 9 | 2.62 | 0 | 0.11 | 0.72 | 3.45 |
| 10 | 0.7 | 0 | 0 | 0 | 0.7 |
| 11 | 0 | 0 | 0 | 0 | 0 |
| 12 | 0 | 0 | 0 | 0 | 0 |
| Total | 81.69 | 0.73 | 10.1 | 7.47 | 99.98 |

Example 1

The Process of the Present Invention

Turning to FIG. 1, the above light naphtha feedstock ($C_5$-$C_{10}$) (1) after desulfurization and dearsenization was preheated by a heater (B1) to a temperature of 475, 520 and 580° C.;subsequently, the pre-heated stream (2)was fed into a dehydrogenation reactor (B2) to contact at a pressure of 0.15 MPa (G) with a fixed bed of Pt—Sn catalyst loaded on alumina carrier to perform a catalytic dehydrogenation reaction so as to obtain a mixture stream (3) containing hydrogen gas, unreacted alkanes and olefins with the same carbon number of the reaction feedstock; the stream (3) was introduced into a heat exchange separator (B3) to cool the stream to 100° C. so as to separate out hydrogen gas and a lower carbon number ($<C_4$) stream (10) from a liquid-phase stream (4) of the unreacted alkanes and the olefins having the same carbon number of the reaction feedstock; the stream (4) was mixed with an overheated diluting steam (9)in a mixer (B4) and heated to 550° C.; the stream (5) obtained by the mixing was fed into an olefin cracking reactor (B5) and contacted at a pressure of 0.15 MPa with a fixed bed of a catalyst having ZSM-5 as carrier and an alkaline earth metal as active component.

A product stream (6)was separated by a separator (B6) to obtain a lower olefin product stream (7)and a stream (8)containing C5 or higher olefins, alkanes and arenes. The obtained product has a composition shown in Table 1.

Comparative Example 1

Catalytic Cracking Technology

The same naphtha feedstock ($C_5$-$C_{10}$) was pre-heated in a convection section to 600° C., fed into a catalytic cracking reactor, contacted at 700, 750, 800° C. with a fixed bed catalyst having a P-La catalyst supported on a ZSM-5 molecular sieve to perform the catalytic reaction.

The obtained product has a composition shown in Table 1.

Comparative Example 2

Steam Cracking Technology

The same naphtha feedstock ($C_5$-$C_{10}$) was pre-heated in a convection section to 580° C., fed into a radiation section for performing a thermal cracking reaction, in which the outlet temperature of the radiation section was 830° C. and 850° C.

The obtained product has a composition shown in Table 1.

TABLE 1

Cracking Product Distribution Of Different Processes

| | Cracking temperature, ° C. | | | | | | | |
|---|---|---|---|---|---|---|---|---|
| | (Catalytic Cracking) | | | Thermal Cracking | | The Present Invention | | |
| | 700 | 750 | 800 | 850 | 830 | 600 | 600 | 600 |
| Dehydrogenation conversion rate (dehydrogenation temperature, ° C.) | — | — | — | — | — | 20% (475) | 45% (520) | 70% (580) |
| Composition | wt % | | | | | | | |
| Hydrogen gas | 0.84 | 0.60 | 0.85 | 0.96 | 0.93 | 1.17 | 1.57 | 2.72 |
| Methane | 12.69 | 11.92 | 13.53 | 15.50 | 14.83 | 2.68 | 3.56 | 2.25 |
| Ethane | 4.31 | 5.35 | 3.61 | 4.00 | 4.07 | 1.20 | 1.31 | 0.81 |
| Ethylene | 18.31 | 21.37 | 25.15 | 29.49 | 28.70 | 16.9 | 19.4 | 8.9 |
| Acetylene | 0.05 | 0.11 | 0.35 | 0.51 | 0.45 | 0.02 | 0.03 | 0.02 |
| Propane | 0.74 | 0.68 | 0.50 | 0.45 | 0.49 | 0.20 | 0.24 | 0.38 |
| Propylene | 15.06 | 16.80 | 14.67 | 16.27 | 14.52 | 12.9 | 16.8 | 27.4 |
| Propyne | 0.14 | 0.25 | 0.22 | 0.47 | 0.44 | 0.05 | 0.06 | 0.10 |
| Allene | 0.03 | 0.12 | 0.29 | 0.25 | 0.24 | 0.02 | 0.03 | 0.02 |
| Iso-butane | 0.20 | 0.14 | 0.13 | 0.04 | 0.06 | 0.08 | 0.17 | 0.21 |
| n-butane | 0.60 | 0.59 | 0.49 | 0.34 | 0.41 | 0.42 | 0.68 | 0.92 |
| butene-1 | 1.30 | 2.03 | 1.58 | 0.85 | 1.09 | 2.21 | 2.45 | 2.87 |
| Iso-butene | 2.23 | 3.25 | 2.39 | 1.82 | 2.12 | 4.77 | 5.01 | 4.25 |
| Trans-butene | 1.16 | 0.80 | 0.54 | 0.70 | 0.62 | 0.69 | 0.78 | 0.91 |
| Cis-butene | 0.96 | 0.65 | 0.35 | 0.31 | 0.36 | 0.91 | 0.99 | 1.08 |
| Butadiene | 2.13 | 3.65 | 4.50 | 3.85 | 4.04 | 5.92 | 6.43 | 7.52 |
| Total | 60.75 | 68.31 | 69.15 | 75.81 | 73.37 | 50.14 | 59.51 | 60.36 |

It can be seen from Table 1 that as compared to the catalytic cracking technology and the thermal cracking technology, the present invention has a lower reaction temperature, a significantly lower contents of hydrogen gas and methane, so that the present invention can significantly reduce energy consumption.

In the process of the present invention, with the increase of dehydrogenation conversion rate, the yields of methane and hydrogen did not significantly change, but the yields of ethylene and propylene, especially propylene increased dramatically. As those skilled in the art can understand, in the process for producing ethylene and propylene from petroleum saturated hydrocarbons, even an improvement of several percentages is a significant progress.

Example 2

Process of the Present Invention

Figure 2:
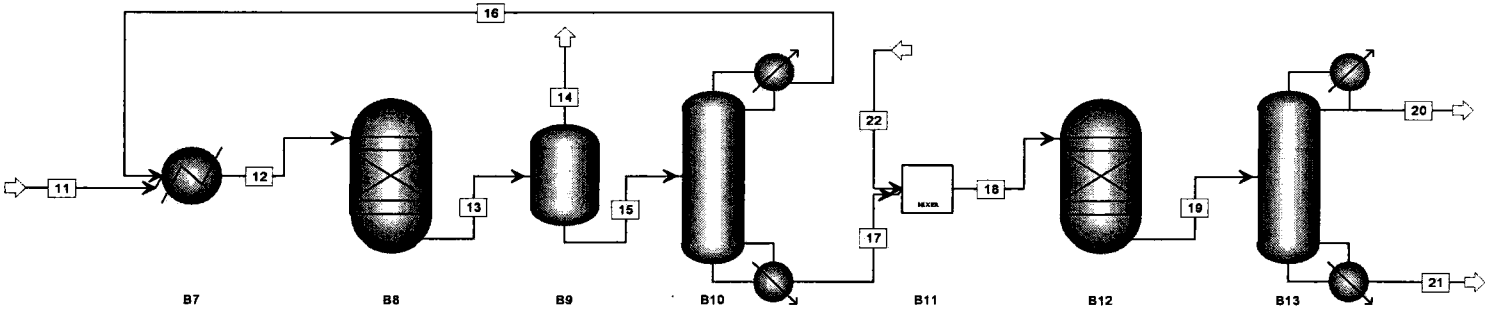
FIG. 2 is a schematic flow diagram of another embodiment according to the present invention.

Turning now to FIG. 2, the above light naphtha feedstock (11 ) after desulfurization and dearsenization was pre-heated by a heat exchanger (B7) to a temperature of 550° C.; subsequently, the pre-heated stream (12) was fed into a dehydrogenation reactor (B8) to contact at a pressure of 0.15 MPa with a fixed bed of Pt—Sn catalyst loaded on alumina carrier to perform a catalytic dehydrogenation reaction so as to obtain a mixture stream (13) containing hydrogen gas, unreacted alkanes and olefins with the same carbon number of the reaction feedstock; the stream (13) was introduced into a heat exchange separator (B9) to cool the stream to 100° C. so as to perform a gas-liquid separation, in which a gas-phase stream (14) was used as a fuel for heating, a liquid stream (15) was fed into a separation column (B10) packed with 5 Å molecular sieves to separate and obtain a stream (16) containing normal alkanes which was fed back and used together with the stream (11) as reaction feedstock, and a mixture stream (17) of olefins was heated in a heat exchanger to about 500° C. and mixed with a diluting steam (22)in a mixer (B11), then the obtained mixture(18)was fed into an olefin cracking reactor (B12) and contacted at a pressure of 0.15 MPa with a fixed bed of a catalyst having HZSM-5, ZSM-5 and ZRP as active components.

A product stream (19) was separated by a separator (B13) to obtain a lower olefin product stream (20) containing 6wt % of ethylene, 35wt % of propylene and 25wt % of mixture butanes, and a stream (21) containing $C_5$ or higher olefins, trace alkanes and arenes.

We claim:

1. A process for producing olefins from petroleum saturated hydrocarbons, comprising the following steps:

a) contacting a feedstock of the petroleum saturated hydrocarbons, which comprises a mixture of hydrocarbons selected from $C_4$-$C_{35}$ saturated hydrocarbons, with a dehydrogenation catalyst in a dehydrogenation reaction zone of a reaction system to obtain a dehydrogenated petroleum hydrocarbon stream containing unsaturated hydrocarbon compounds, in which the dehydrogenation reaction has a conversion rate of at least 45% based on weight; and b) contacting the obtained dehydrogenated petroleum hydrocarbon stream containing the unsaturated hydrocarbon compounds with an olefin cracking catalyst in an olefin cracking zone of the reaction system to obtain a product stream containing ethylene and propylene.

2. The process according to claim 1, wherein the dehydrogenated petroleum hydrocarbon stream containing the unsaturated hydrocarbon compounds is subjected to a gas-liquid separation to separate out $C_4$ or less components and hydrogen from the dehydrogenated stream, prior to being introduced into the olefin cracking reaction zone.

3. The process according to claim 1, wherein the petroleum saturated hydrocarbons feedstock comprises a mixture of hydrocarbons selected from $C_6$-$C_{20}$ saturated hydrocarbons.

4. The process according to claim 3, wherein the petroleum saturated hydrocarbons feedstock is selected from the group consisting of topped oil, pentane oil, naphtha, a mixture of normal alkanes, or a mixture thereof.

5. The process according to claim 1, wherein the dehydrogenation reaction of the step a) is performed at a temperature of 300 to 700° C.;

a pressure of 0 to 1000 kPa; and a space velocity of 0.5 to 10 $h^{-1}$.

6. The process according to claim 1, wherein the dehydrogenation reaction of the step a) has a conversion rate of at least 70% based on weight.

7. The process according to claim 1, wherein the olefin cracking reaction of the step b) is performed at a temperature of 500° C. to 600° C., a pressure of 1 bar to 3 bar, and a space velocity of 3 $h^{-1}$ to 8 $h^{-1}$.

8. The process according to claim 1, wherein a diluent selected from hydrogen gas, water steam and a combination thereof is used in the dehydrogenation reaction of step a) and/or the olefin catalytic cracking reaction of step b).

9. The process according to claim 1 further comprising step c), wherein the product stream obtained in the step b) is separated to obtain a product comprising $C_2$ olefin, $C_3$ olefins and/or $C_4$ olefins as major component, and a product comprising $C_5$, $C_6$, $C_7$, $C_8$ and/or C9 olefins as major component.

10. The process according to claim 1, wherein the dehydrogenation catalyst comprises an active component selected from the group consisting of Pt, Pb, chromium oxides, Ni and combinations thereof on a carrier selected from the group consisting of alumina, molecular sieves, kaolin, diatomite, silica and combinations thereof, and an optional additive component selected from the group consisting of Sn, alkali metals, alkaline earth metals and combinations thereof.

11. The process according to claim 1, wherein the olefin cracking catalyst is a modified or unmodified molecular sieve selected from SAPO molecular sieves, ZSM molecular sieves, MOM molecular sieves and combinations thereof, and the molecular sieve has a pore diameter of 4 to 7 angstroms.

12. The process according to claim 1, wherein the dehydrogenation reaction zone and/or the olefin cracking zone are in the form of fixed beds or fluidized beds.

13. The process according to claim 1, wherein the product stream containing propylene as a major component.

14. The process according to claim 5, wherein the dehydrogenation reaction of step a) is performed at a temperature of 400 to 600° C.; a pressure of 0 to 300 kPa; and a space velocity of 1 to 5 $h^{-1}$.

15. The process according to claim 12, wherein the dehydrogenation reaction zone and/or the olefin cracking zone are in the form of fixed beds.

* * * * *

UNITED STATES PATENT AND TRADEMARK OFFICE

CERTIFICATE OF CORRECTION

PATENT NO. : 9,024,100 B2
APPLICATION NO. : 12/669269
DATED : May 5, 2015
INVENTOR(S) : Guoqing Wang et al.

It is certified that error appears in the above-identified patent and that said Letters Patent is hereby corrected as shown below:

In the Claims

Claim 11, col. 12, line 29, "MOM molecular sieves" should read -- MCM molecular sieves --.

Signed and Sealed this
Eighth Day of September, 2015

Michelle K. Lee

Michelle K. Lee
*Director of the United States Patent and Trademark Office*